United States Patent [19]

Mielke

[11] 3,973,488

[45] Aug. 10, 1976

[54] PRINTING UNIT PARTICULARLY INTENDED FOR PRICE LABELLING MACHINES

[75] Inventor: Klaus Heinrich Mielke, Molnlycke, Sweden

[73] Assignee: Oscar Adolf Engelbert Wallmark, Bohus, Sweden

[22] Filed: Dec. 23, 1974

[21] Appl. No.: 535,502

[30] Foreign Application Priority Data

Feb. 4, 1974 Sweden ..... 74014444

[52] U.S. Cl. ..... 101/110; 101/93.2; 101/99; 101/93.04; 197/55

[51] Int. Cl.[2] ..... B41J 1/44

[58] Field of Search ..... 101/110, 93.24, 93.25, 101/95, 99, 96, 93.3, 93.04, 93.22, 93.47, 93.37–93.46; 197/18, 55

[56] References Cited

UNITED STATES PATENTS

| | | | |
|---|---|---|---|
| 1,909,550 | 5/1933 | Peirce | 101/93.22 X |
| 2,966,843 | 1/1961 | Eckley | 101/110 |
| 3,353,648 | 11/1967 | Amada et al. | 197/55 |
| 3,752,068 | 8/1973 | Tramposch et al. | 101/93.47 |
| 3,788,443 | 1/1974 | Menzi | 17/55 X |
| 3,807,542 | 4/1974 | Jung | 197/55 |
| 3,825,102 | 7/1974 | Decker | 197/55 |
| 3,832,942 | 9/1974 | Murayoshi | 101/93.31 |
| 3,861,302 | 1/1975 | Mizutani et al. | 101/110 X |

*Primary Examiner*—Edgar R. Burr
*Assistant Examiner*—Edward M. Coven
*Attorney, Agent, or Firm*—Harness, Dickey & Pierce

[57] ABSTRACT

A printing unit particularly intended for price labelling machines, comprising annular printing wheels supporting matrices at their outer periphery and equidistantly spaced notches at their inner periphery into which notches engages a rod to advance the wheels to forward the desired matrix to printing position. The printing pressure is obtained by an impact rod striking a shoulder formed on a pressure arm, the movement of which is transferred to the associated printing wheel forcing the intended matrix thereon against the place of printing. As the printing wheel is stationary during the printing operation the resulting print is sharp and clear.

5 Claims, 12 Drawing Figures

47
12
4
46
1
44
7
11
3
46
8
49
6
9
16
36
10
43
21
20
II
II
38
22
17
5
19
50
15
14
13
45
2
48
46

30
18
32
31
33
11
21
6
7
12
41
8
24
16
9
5
22
34
43
36
37
42
40
19

PRINTING UNIT PARTICULARLY INTENDED FOR PRICE LABELLING MACHINES

BACKGROUND OF THE INVENTION

Various types of printing units intended for price labelling machines are already known. In one type of such units, number and letter printing matrices to print various signs on e.g., price labels are arranged on the peripheries of pivotally mounted printing segments which upon operation of various actuating means may be brought to printing position. Printing units of this kind require a large number of movable components and they are space-requiring and expensive to manufacture. In another type of printing units, the printing is effected by means of rotating printing wheels. As the printing is effected during the rotation of the printing wheels the resulting text lacks clarity.

SUMMARY OF THE INVENTION

The printing unit in accordance with the present invention remedies the drawbacks outlined above. This printing unit is of the kind incorporating a number of printing wheels arranged in a row and having printing matrices at the wheel peripheries. It is characteristic of the invention that each printing wheel is rotatably mounted on its associated carrier arm, and that the printing wheels are arranged to be advanced an equal number of pitches (steps) by a common advancement rod, the printing wheel arms being pivotably interconnected with one pressure arm, each cooperating with a rotatably driven impact rod, said pressure arm arranged to be moved, through the action of an electromagnet connected to a place-determining means, to a position wherein an abutment shoulder or similar means formed on the pressure arm bars the path of movement of the impact rod and thus is forced by said rod to deflect sidewise while bringing the pressure arm along in its movement, the pressure arm in turn striking the printing wheels, so as to press the matrix which at that moment has been advanced to printing position, against the printing place. The printing wheels are stationary during the printing operation proper, for which reason the printed text becomes sharp and clear. The printing unit comprises a comparative small number of components. The printing unit is well suited for printing segmentary letters, i.e., letters or numbers composed of a plurality of signs or parts.

In accordance with a preferred embodiment each printing wheel is annular and provided at its inner periphery with evenly spaced notches the number of which corresponds to the number of matrices at the outer wheel periphery and into which the advancement rod is arranged to engage in succession upon each revolution of the rod to advance the printing wheels over the same portion of one revolution. Through this arrangement the advancement of the printing wheels to bring the desired one of the printing matrices to printing position becomes very smooth and gentle and the rotational speed of the advancement rod consequently may be very high. The efficiency of the printing unit becomes extremely high.

BRIEF DESCRIPTION OF THE DRAWINGS

The invention will be described in detail in the following with reference to the accompanying drawings, wherein.

DETAILED DESCRIPTION OF A PREFERRED EMBODIMENT

Figure 1:
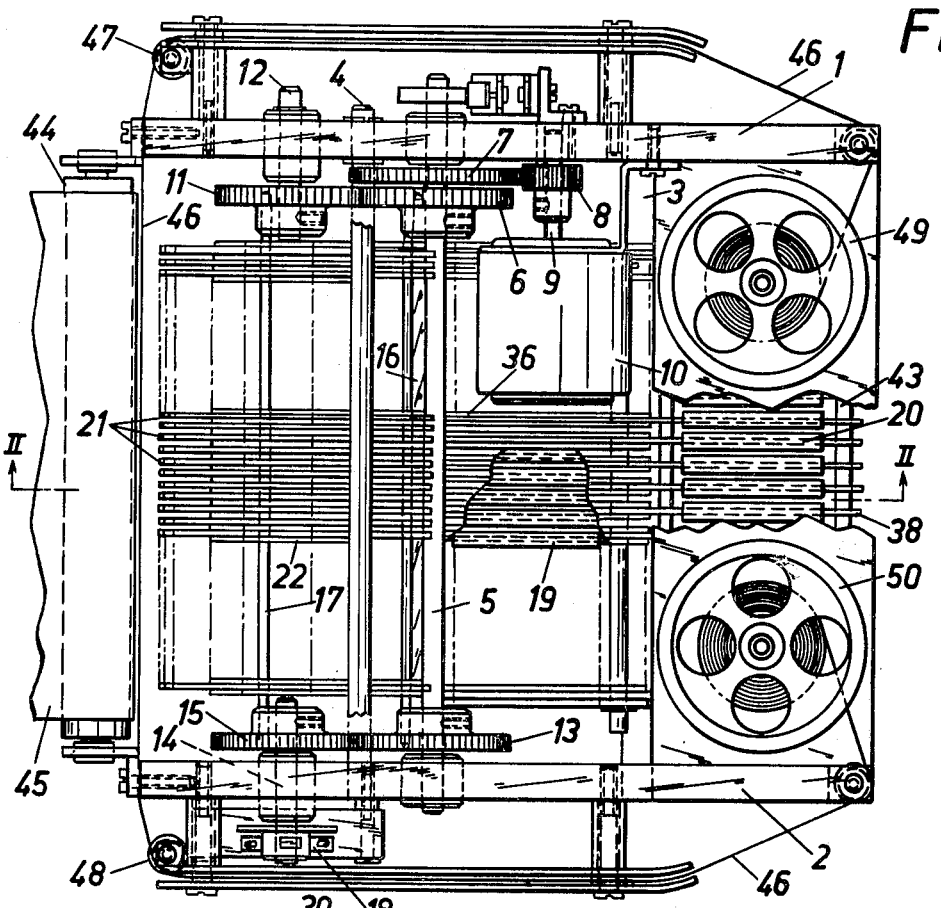
FIG. 1 is a plan view of a printing unit in accordance with the invention.

The casing of the printing unit is imagined composed by two end elements 1, 2 kept together by a number of distance bolts 3, 4. A shaft 5 is rotatably mounted in the end elements 1, 2 and supports internally of the end element 1 two cog wheels 6, 7 of which cog wheel 7 cooperates with a driving wheel 8 mounted on the shaft 9 of an electric motor 10. The cog wheel 6 cooperates with a cog wheel 11 on a second shaft 12 mounted in the end element 1. The opposite end of the shaft 5 supports a cog wheel 13 cooperating with a cog wheel 15 disposed on a shaft 14 mounted in the end element 2. The transmission (gear) ratio between the shaft 5 and shafts 12, 14 is 1:1. The shaft 5 is provided with an impact rod 16 extending along the shaft and integral therewith. Between the shafts 12 and 14 extends an eccentrically disposed advancement rod 17. The shaft 14 drives a position determining means 18, the latter being electrically connected with a number of electromagnets 19, 20 arranged in two rows. The position determining means, as will be described, is constructed to provide an electrical signal indicative of the angular position of the shaft 14.

Figure 2:
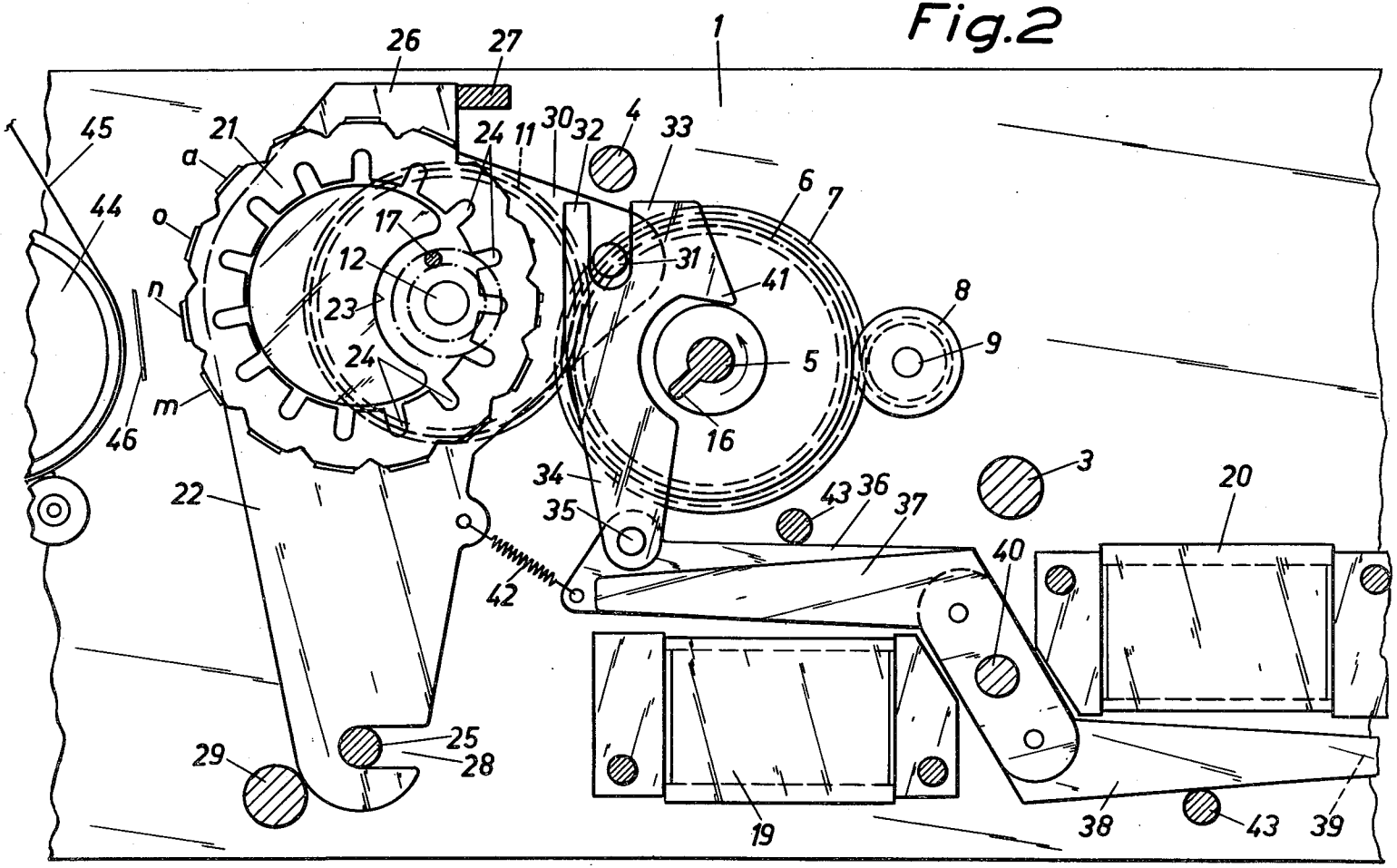
FIG. 2 illustrates on an enlarged scale a vertical cross-sectional view through the printing unit of FIG. 1, certain details having been eliminated for more clarity.

The printing unit comprises a number of printing wheels 21 arranged in a longitudinal row and each rotatably mounted at the upper end of a plate-shaped arm 22. The printing wheels 21 are annular and each one provided at its periphery with a number of printing matrices *a, b, c, d, e, f, g, h, i, j, k, l, m, n,* and *o,* having e.g. the configuration appearing from FIG. 5. The arms 22 have one notch 23 each through which the advancement rod 17 passes freely. The notch 23 is sufficiently large so as to permit rotation of the advancement rod 17 about its eccentric axis without interferance with the arms 22. Each printing wheel 21 is provided at its inner periphery with notches 24 corresponding to the number of the printing matrices and the advancement rod 17 may engage in these notches, one by one in succession, during one rotation of the shafts 12, 14 in order to advance the printing wheels 12 one pitch (step) (or two steps, in accordance with the embodiment illustrated wherein each printing wheel has fifteen, i.e., an uneven number of printing matrices). As may be seen in FIG. 2, the notch 23 and central opening in the wheels 21 is sufficient to permit free rotation of the advancement rod 17 when the printing wheel arms 22 are in their non-printing position. At their lower ends the printing wheel arms 22 are pivotally mounted about a longitudinal shaft 25 and at their upper ends each arm presents a stop shoulder 26 arranged through its abutment against a longitudinally extending rod 27 to stop the arm movement in inoperative position (FIG. 2). At their lower ends the printing wheel arms are provided with a slit 28 formed so as to allow the arms to be threaded onto the shaft 25 from the front. Thus mounted, the arms are retained in this pivotable position by a rod 29 passing through the end elements 1, 2.

Figure 4:
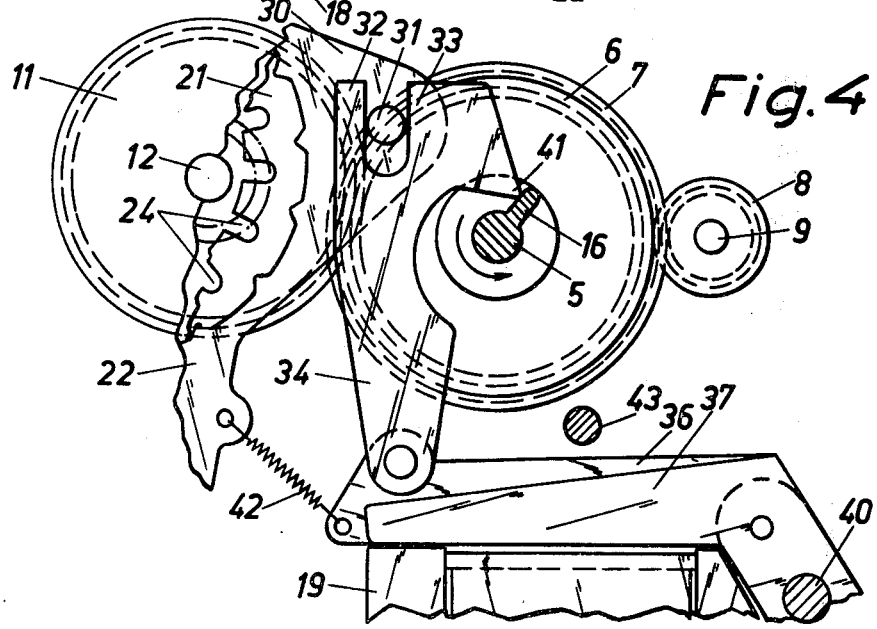
FIG. 4 shows the same parts immediately prior to advancement of the printing wheels to position of printing.
Figure 3:
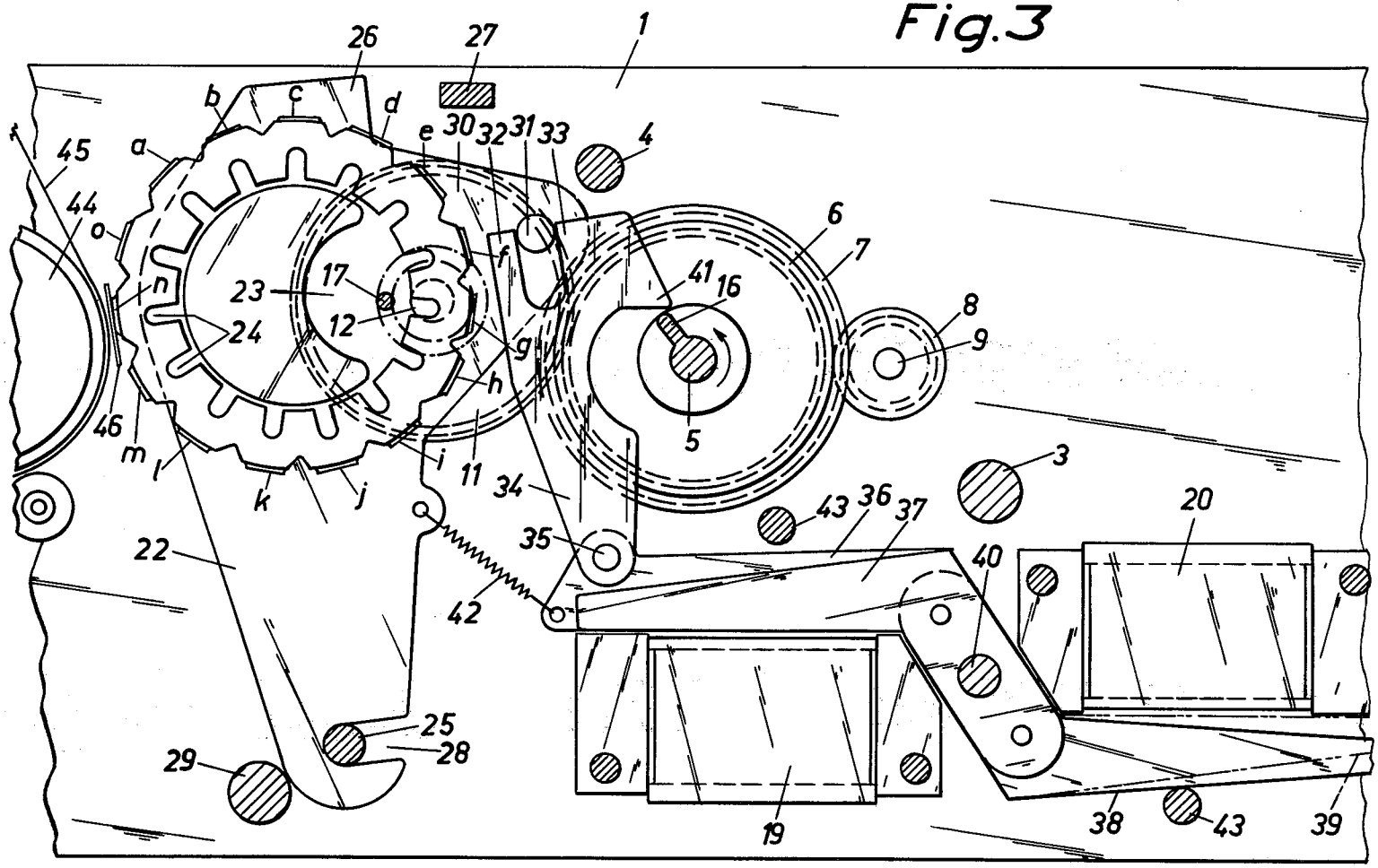
FIG. 3 is a similar cross-sectional view illustrating the movable parts of the printing unit in position of printing.

The printing wheel arms 22 are provided with one rearwardly (to the right according to FIGS. 2 – 4) directed protrusion 30 each, on which protrusion a follower pin 31 is mounted so as to engage the upwardly directed legs 32, 33 of a fork-like pressure arm 34 the lower end of which is articulated by means of a bolt 35 to an actuating arm 36 supporting the armature 37 of one of the electro-magnets 19 in the first row. The adjacent actuating arm 38, similarly hingedly interconnected with its respective pressure arm 34, supports the armature 39 of one of the electro-magnets 20 in the second row. Both arms 36 and 38 are pivotally mounted about a longitudinally extending shaft 40. Each pressure arm 34 has a rearwardly directed nose portion 41 serving as an abutment means arranged so as to cooperate with the impact rod 16. Between each printing wheel arm 22 and its associated actuating arm 36 is mounted a traction spring 42 retaining the actuating arm 36 in position against a stop abutment 43 in the upper, inoperative position of the presssure arm 34 wherein the latter is in a sufficiently raised position (FIG. 2) for the nose portion 41 to be outside the path of movement of the impact rod 16 during the rotation of the latter.

At the left side of the printing unit is rotatably mounted a counter roller 44 over which is advanced a paper web, e.g. a support band carrying price tags. An inked ribbon 46 runs between the printing wheels 21 and the counter roller 44, said ribbon being supplied over pulleys 47, 48 from a supply roller 49 to a collection roller 50 and the reverse.

The motor 10 drives the shafts 12, 14 continuously, together with the advancement rod 17 disposed between the shafts, at the same pace as the impact rod 16. The positions of the printing wheel arms 22 and the pressure arms 34 are initially the one illustrated in FIG. 2. For every revolution of the shafts 12, 14 together with the advancement rod 17 all printing wheels 21 are advanced two pitches (steps) and the step-wise advancement of the wheels proceeds until the position determining device 18 closes the circuit to any one of the electro-magnets - this device 18 consisting e.g., of a contact means advanced stepwise by the shaft 14 and part of which is continually in contact with a contact ring and another part of which is brought into contact with contact pieces connected to the various electro-magnets 19, 20. The electro-magnet in question then attracts the armature 37, resulting in the actuating arm 36 swinging in the anti-clockwise direction in accordance with the position illustrated in FIG. 4, whereby the pressure arm 34 is lowered sufficiently for the nose portion 41 to obstruct the path of movement of the impact rod 16 on the continuously rotating shaft 5. Consequently, the impact rod 16 hits the pressure arm 34, swinging it about the articulation bolt 35 to the left, whereby via the leg 33 and the pin 31 the movement of the pressure arm is transmitted to the printing wheel arm 22 the upper portion of which swings to the left about shaft 25. As a consequence, the printing matrix *n* (see FIG. 3) on the printing wheel 21 hits against the inked ribbon 46 depositing a corresponding sign on the paper web 45. When the printing wheel 21 and arm 22 have pivoted to the printing position (FIG. 3), the advancement rod 17 is in the dwell portion of its cycle. The amount of eccentricity of the rotational axis of the rod 17 is such that it will not interfere with movement of the arm 22 and printing wheel 21 to their printing positions. Following each individual printing operation the movable parts just mentioned are returned to their original positions (FIG. 2) by the spring 42. The latter may be comparatively weak, dispensed with even, as the advancement rod 17 which is brought to engage in the following notch 24, swings the printing wheel arm 22 backwards, until the stop shoulder 26 thereon abuts against the rod 27. The application of signs continues in the manner described above until the desired letters and/or numbers are applied on the paper web 45.

Figure 5:
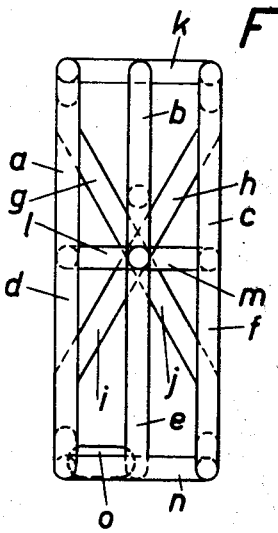
FIG. 5 illustrates on an even larger scale the various matrices incorporated in one single printing wheel.
Figure 5B:
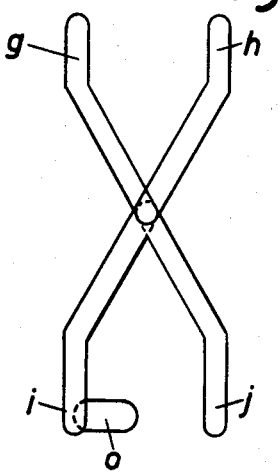
FIGS. 5*a* through 5*e* illustrate on the same scale as FIG. 5 the respective series of matrices on a single printing wheel.
Figure 5A:
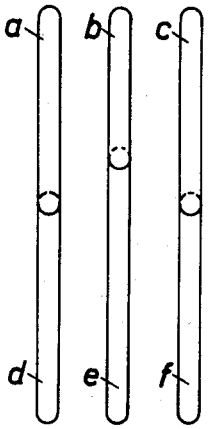
Figure 5C:
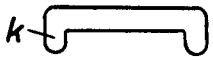
Figure 5D:
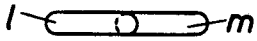
Figure 5E:
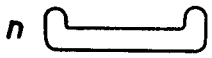
Figure 6:
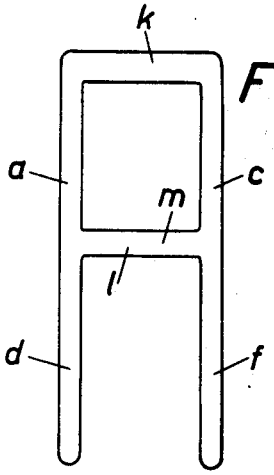
FIG. 6 shows the structure of a letter composed from signs or parts from various matrices on one and the same printing wheel.
Figure 7:
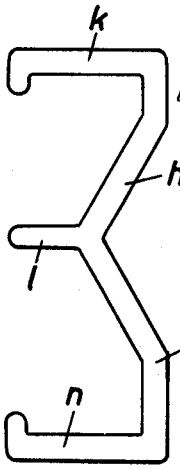
FIG. 7 illustrates a number, likewise composed from parts from various matrices on a printing wheel.

FIG. 5 and FIGS. 5*a* through 5*e* illustrate on an enlarged scale the various matrices *a, b, c, d, e, f, g, h, i, j, k, l, m, n,* and *o,* required on each printing wheel 21 when a letter style composed of fifteen segments is to be applied. In FIG. 5, are illustrated the relative positions of the various matrices on each printing wheel while FIGS. 5*a* through 5*e* illustrate the individual matrices on each wheel. FIG. 6 illustrates the letter A the printing of which requires matrices *a, c, d, f, k, l,* and *m.* FIG. 7 illustrates the number 3 the printing of which requires matrices *h, j, k, l,* and *n.* The matrix *o* is used as the full stop sign. It may be necessary to equip at least some of the printing wheels 21 with further matrices for printing e.g., the comma and colon signs.

The printing unit described and illustrated in the drawings is to be regarded as an example only and its various parts may be constructively altered in a variety of ways within the scope of the appended claims. The electro-magnets 19, 20 which for the sake of space economy are arranged in two rows side by side may be arranged in a further number of rows. The mounting of the printing wheel arms 22 and the pressure arms 34 may be in a position inverse to the one illustrated in the drawings, i.e., the pivot axes 25 and 35 may be positioned above the printing wheels 21 and the follower pin 31, respectively. Other letter styles than segment style are of course possible. The impulses from the various electro-magnets 19, 20 may be in binary or decimal form. The printing unit may also be used as a line printer. The matrices *a* to *o* may be integral with the rest of the printing wheel 21.

The embodiment illustrated in the drawings allows each pressure arm to be equipped with an electric contact or other sensing device whereby an efficient control (so-called echo control) of each printing operation may be achieved.

What I claim is:

1. An improved printing unit, particularly intended for price labelling machines, comprising a plurality of printing wheels, a plurality of pivotally supported carrier arms equal in number to the number of said printing wheels and juxtaposed to each other in side-by-side relationship, means rotatably supporting each of said printing wheels on a respective one of said carrier arms with said printing wheels being positioned in a row and presenting printing matrices on their respective outer peripheries, intermittent drive means having a common driving element operatively coupled to each of said printing wheels for advancing said printing wheels simultaneously over an equal number of degrees of incremental rotation, a plurality of pivotable pressure arms equal in number to the number of said carrier arms, means providing an operative connection between each of said pressure arms and a respective one of said carrier arms for pivoting a respective carrier arm upon pivotal movement of the respective pressure arm, a rotatably driven impact member, shoulder means formed on said pressure arms, said pressure arms being movable between a non-printing position in which said shoulder means is free of engagement with said impact member and a printing position in which said shoulder means is positioned to be engaged by said impact member for pivoting said pressure arms and said carrier arms for bringing the respective printing wheel into engagement with the article to be imprinted, a position determining device responsive to the angular position of said printing wheels, electromagnetic means operatively connected to said position determining device for operation thereby, motion transmitting means operably connected to said electromagnetic means for moving selected of said pressure arms into a position wherein said shoulder means is positioned to be contacted by said impact member for pivotally moving said selected pressure arms and their associated carrier arms for pressing the matrix in printing positon on the associated printing wheel into engagement with the article to be imprinted.

2. An improved printing unit as claimed in claim 1 wherein each printing wheel is annular and formed at its inner periphery with a number of equidistantly spaced notches, the number of said notches corresponding to the number of matrices at the outer printing wheel periphery, the common drive means comprising an advancement rod supported for rotation about an eccentric axis and arranged to engage each one of said notches, one by one, upon every revolution of said rod so as to advance said printing wheels over the same part of one revolution.

3. An improved printing unit as claimed in claim 2, wherein the advancement rod engages the area of the printing wheel between said notches when said carrier arms are in their printing positions for exerting a return force on said carrier arms during part of its revolution to move said carrier arms to their original position.

4. An improved printing unit as claimed in claim 3, comprising a shaft to which all said carrier arms are articulated at one of their ends, the opposite ends of said carrier arms support said printing wheels.

5. An improved printing unit as claimed in claim 1, comprising one of the ends of said pressure arms being pivotally mounted to an armature of said electromagnetic means whereas the opposite pressure arm ends are formed with said shoulder means cooperating with said impact rod.

* * * * *